US006861626B2

(12) United States Patent
Ogasawara et al.

(10) Patent No.: US 6,861,626 B2
(45) Date of Patent: Mar. 1, 2005

(54) INDUCTION HEATING ROLLER DEVICE FOR USE IN IMAGE FORMING APPARATUS

(75) Inventors: Takayuki Ogasawara, Yokohama (JP); Hiroyuki Doi, Yokohama (JP); Ichiro Yokozeki, Yokosuka (JP); Manabu Kika, Kamakura (JP); Toshiya Suzuki, Yokosuka (JP); Takaaki Tanaka, Yokosuka (JP); Syouhei Maeda, Yokosuka (JP)

(73) Assignee: Harison Toshiba Lighting Corp., Ehine (JP)

( * ) Notice: Subject to any disclaimer, the term of this patent is extended or adjusted under 35 U.S.C. 154(b) by 0 days.

(21) Appl. No.: 10/732,981

(22) Filed: Dec. 11, 2003

(65) Prior Publication Data

US 2004/0149735 A1 Aug. 5, 2004

(30) Foreign Application Priority Data

Dec. 18, 2002 (JP) ..... 2002-367289

(51) Int. Cl.[7] ..... H05B 6/14; G03G 15/20

(52) U.S. Cl. ..... 219/619; 219/661; 219/666; 219/668; 399/328; 399/330

(58) Field of Search ..... 219/619, 668, 219/660–666; 399/328–335

(56) References Cited

U.S. PATENT DOCUMENTS 6,359,269 B1 * 3/2002 Hayasaki et al. ..... 219/665
6,438,335 B1 * 8/2002 Kinouchi et al. ..... 399/328
6,573,485 B2 * 6/2003 Yokozeki ..... 219/619

FOREIGN PATENT DOCUMENTS

JP 2002-222688 9/2002

* cited by examiner

*Primary Examiner*—Philip H. Leung
(74) *Attorney, Agent, or Firm*—Jenkens & Gilchrist, PC

(57) ABSTRACT

An induction heating roller device that keeps leakage current within specifications and prevents the occurrence of erroneous operations caused by common mode noise. The induction heating roller device includes an induction coil, a grounded heating roller magnetically coupled to the induction coil and heated by electro-magnetic induction. A power factor improving capacitor is connected in parallel to and near the induction coil and has a grounded intermediate point. A high-frequency power source biases the induction coil. The leakage current produced by distributed capacitance between the induction coil and the heating roller is returned to the high-frequency power source via the power factor improving capacitor. Thus, the leakage current does not flow out of the induction heating roller device.

15 Claims, 5 Drawing Sheets

INDUCTION HEATING ROLLER DEVICE FOR USE IN IMAGE FORMING APPARATUS

BACKGROUND OF THE INVENTION

The present invention relates to an induction heating roller device, and to a fixing device and image forming apparatus provided with the induction heating roller device.

Conventionally, heating rollers using a halogen lamp as a heat source are employed to thermally fix a toner image. However, such heat sources require a long warm up time and the heat capacity may be insufficient. Therefore, induction heating methods are being developed to resolve such problems.

As described in Japanese Laid-Open Patent Publication No. 2002-222688, the inventors of the present invention have developed an image forming apparatus and fixing device using an induction heating roller device of the transformer coupling type. The heating roller device includes a heating roller having a hollow structure in which an induction coil is air-core transformer coupled to an induction coil and rotatably supported. A secondary side resistance value of the heating roller is obtained from a closed circuit having a secondary reactance that is substantially equal to the secondary reactance. The invention conserves power used by the heating roller in induction heating and readily increases the speed of thermal fixing.

Since the induction coil is arranged in the heating roller, the temperature of the induction coil becomes high during operation. Therefore, when arranging a matching circuit or a high-frequency power source near the induction coil, the matching circuit and the high-frequency power source must have a high heat-resistance level or be protected from the heat of the heating roller and the induction coil. However, this would increase costs. Further, an increase in the heat-resistance level would enlarge the matching circuit or the high-frequency power supply. This would enlarge a fixing device or an image forming apparatus that incorporates the fixing device.

To solve this problem, the high-frequency power source and the matching circuit may be separated from the induction coil, and a high-frequency transmission line may connect the matching circuit and the induction coil.

The coupling co-efficient of the induction coil and the heating roller is normally small. This decreases the power factor of the current flowing through the induction coil and increases the power capacity (VA) of the high-frequency current flowing through the high-frequency transmission line. In addition, the wire inductance of the high-frequency transmission line between the matching circuit and the inductance coil becomes such that it cannot be ignored. This further decreases the power factor of the current flowing through the induction coil. Thus, the wire diameter of the high-frequency transmission line must be increased or the heat resistance grade of the high-frequency transmission line must be increased. This increases the cost of the high-frequency transmission line. Further, an increase in the VA of the high-frequency transmission line increases the noise emitted outward from the high-frequency transmission line. This may cause erroneous operation of the surrounding electronic circuits.

To solve this problem, the inventors of the present invention have proposed an induction coil device including an induction coil, a heating roller that is magnetically coupled to the induction coil to be heated by electromagnetic induction, a power factor improving means arranged near the induction coil, a high-frequency power source, a high-frequency transmission line, and a matching circuit. This invention decreases the VA of the high-frequency transmission line and decreases the noise emitted outward from the high-frequency transmission line thereby solving the above problem.

To increase the efficiency for transmitting power from the induction coil to the heating roller, the magnetic coupling between the induction coil and the heating roller must be strengthened. However, when the distance between the induction coil and the heating roller is decreased, the distributed capacitance between the induction coil and the heating roller becomes relatively large because distributed capacitance exists between the induction coil and the heating roller. The distributed capacitance may be several tens of pF or greater. When the frequency of the high-frequency power supplied to the induction coil is several hundred kHz or greater and the high-frequency voltage applied to the induction coil is several hundred V or greater, the leakage current resulting from the distributed capacitance increases. This exceeds the leakage current specification of an image forming apparatus in which the induction heating roller device is incorporated as a fixing device.

The leakage current produces common mode noise and causes erroneous operation of the induction heating roller device and the image forming device.

SUMMARY OF THE INVENTION

It is a first object of the present invention to provide an induction heating roller device that keeps. leakage current within specifications and prevents the occurrence of erroneous operations caused by common mode noise.

It is a second object of the present invention to provide an induction heating roller device that reduces the noise emitted from the high-frequency transmission line, keeps leakage current within specifications, and prevents the occurrence of erroneous operations caused by common mode noise.

A first aspect of the present invention provides an induction heating roller device including an induction coil, a heating roller that is magnetically coupled to the induction coil to be heated by electromagnetic induction and connected in parallel to and near the induction coil, a power factor improving capacitor having a grounded intermediate point, and a high-frequency power source for biasing the induction coil.

In the present invention and each invention below, the definitions of terms are not specifically limited, and the technical meanings are described below.

[Induction Coil]

An induction coil is biased, or excited, by a high-frequency power source either directly or through a high-frequency transmission line, inserted through a hollow heating roller, magnetically connected to the heating roller as a primary coil, for example, as in an air-core transformer. The induction coil may be stationary relative to the rotating heating roller or may rotate together with or separately from the heating roller. When the induction coil is rotated, a rotating current collector mechanism may be arranged between high-frequency power source and the induction coil. In this case, the term "air-core transformer coupling" includes not only transformer coupling of an entire air-core, but also transformer coupling of a substantial air-core. However, electromagnetic couplings of the eddy current loss heating technique type may also be used if necessary.

The induction coil may be supported by a coil bobbin. However, instead of a coil bobbin, the induction coil may be configured to maintain a specific shape by directly forming or adhering the induction coil using synthetic resin or glass.

Further, there may be just one induction coil. Alternatively, there may be more than one induction coil. When using only one induction coil, the induction coil is arranged in or near the middle of the heating roller. When using more than one primary coil, the primary coils may be arranged in a dispersed state along the axial direction of the heating coil. Further, the induction coils may be arranged parallel to the high-frequency power source. However, if necessary, a plurality of induction coils may be connected in series.

[Heating Roller]

The heating roller is provided with a secondary coil, which configures a closed circuit used in a grounded state, and the secondary coil is magnetically coupled with the secondary coil, for example, as in air-core transformer coupling. In the latter case, the secondary side resistance value of the closed circuit is a value substantially equal to the secondary reactance of the secondary coil. The secondary side resistance value being "substantially equal" to the secondary reactance refers to a range satisfying Equation 1 below when the secondary side resistance value is designated Ra, the secondary reactance is designated Xa, and $\alpha$=Ra/Xa is satisfied. The reasons for stipulating this mathematical condition are disclosed in Japanese Patent Application No. 2001-016335 filed by the present inventors. The secondary side resistance value may be determined by measurement. The secondary reactance may be determined by calculation. The value of $\alpha$ is in a range from 0.25 to 4, and optimally, in a range from 0.5 to 2.

$$0.1<\alpha<10 \qquad \text{Equation 1}$$

The heating roller may include an arrangement of one or more secondary coils. When there are a plurality of secondary coils, it is preferred that the secondary coils are dispersed in the axial direction of the heating roller. A roller base formed of an insulating material may be used to support the secondary coils. The secondary coil may be arranged on the outer surface, the inner surface, or within the roller base.

The secondary coil may be formed of a conductive member such as a conductive layer, a conductive wire, a conductive plate, and the like. The conductive layer may be formed using the following materials and manufacturing methods to obtain the desired secondary side resistance value. When a thick layer-forming method (application and calcination) is used, materials may be selected from among the group of Ag, Ag+Pd, Au, Pt, $RuO_2$, and C. Screen printing methods, roll coating methods, spray methods and the like may be employed as the application method. Conversely, when plating, deposition, and sputtering methods are used, materials may be selected from among the group of Au, Ag, Ni, and Cu+(Au, Ag). Conductive wires and conductive plates may use copper or aluminum.

To obtain a more practical heating roller, it is desirable that the following structures be added.

1. Roller Base

A roller base formed of an insulating material may be used to support the secondary coil. In this case, the secondary coil may be arranged at the outer surface, inner surface, or inside the roller base. The insulated roller base may be formed using ceramics or glass. In considering heat resistance, strong impact resistant characteristics, and mechanical strength, the following materials may be used. Examples of useful ceramics include alumina, mullite, aluminum nitride, silicon nitride and the like. Examples of useful glass include, crystallized glass, quartz glass, and Pyrex (registered trademark).

2. Heat Diffusion Layer

The heat diffusion layer, which functions as a means of improving the temperature uniformity in the axial direction of the heating roller, may be arranged on the top side of the conductive layer as required. For this reason, it is desirable that the heat diffusion layer be formed of a material having superior heat conduction in the axial direction of the heating roller. Materials having high thermal conductivity can often be found among metals having high electric conductivity, such as Cu, Al, Au, Ag, and Pt. However, the heat diffusion layer is required only to have a thermal conductivity equal to or greater than that of the material forming the conductive layer. Accordingly, the heat diffusion layer also may be formed of the same material as the conductive layer.

Furthermore, when the heat diffusion layer is formed of a conductive material, the heat diffusion layer may be in conductive contact with the conductive layer. However, the emission of noise is blocked by arranging the heat diffusion layer on an insulating film. Since the effect of a high-frequency magnetic field does not reach as far as the heat diffusion layer, a secondary current that contributes to heating is not induced in the heat diffusion layer.

3. Protective Layer

A protective layer may be arranged as necessary to provide mechanical protection and electrical insulation of the heating roller, or to improve the elastic contact characteristics and toner separation characteristics of the heating roller. Glass may be used as the structural material of the protective layer for mechanical protection and electrical insulation of the heating roller, and synthetic resin may be used as the structural material of the protective layer to improve the elastic contact characteristics and the toner separation characteristics of the heating roller. The glass material used may be selected from among a group including zinc borosilicate glass, lead borosilicate glass, borosilicate glass, and aluminosilicate glass. The synthetic resin material may be selected from among a group including silicone resin, fluororesin, polyimide resin+fluororesin, and polyimide+fluororesin. In the cases of polyimide resin+fluororesin and polyimide+fluororesin, the fluororesin is disposed on the outer side.

4. Heating Roller Shape

A crown may be formed on the heating roller if desired. The crown may have a drum shape or a barrel shape.

5. Rotation Mechanism of the Heating Roller

The mechanism used to rotate the heating roller may be suitably selected from among known mechanisms. A construction may be used wherein a pressure roller is disposed opposite the heating roller, such that when a recording medium bearing a toner image passes between the heating roller and the pressure roller, the toner image is heated and fused onto the recording medium.

[Power Factor Improving Capacitor]

A power factor improving capacitor is a means in which the power factor of the high frequency current supplied from the high frequency power source is high, preferably 0.85 or greater. Further, the power factor improving capacitor functions as a regeneration circuit for the leakage current resulting from distributed capacitance. The reactance of the induction coil is mainly determined by the inductance thereof. Accordingly, by connecting the power factor improving capacitor in series with the induction coil, capacitance is obtained, which reduces the reactance of load and improves the power factor. In the terminal end side of the high frequency transmission line, the capacitance is obtained by connecting a capacitor parallel to and near the induction coil and decreases the VA of the high frequency current flowing through the high frequency transmission line.

The power factor improving capacitor may be arranged outside or inside the heating roller as long as it is in the proximity of the heating roller. The term "in the proximity of the induction coil" refers to the power factor improving capacitor being arranged outside the heating roller and at a position whether the wire length from one end of the heating roller is 50 mm or less. Further, when the power factor improving capacitor is arranged inside the heating roller, the ambient temperature increases. It is thus preferred that a ceramic capacitor having a high heat resistance level is used.

Further, the power factor improving capacitor generally includes a pair of series-connected capacitors. The two ends of the series-connected capacitors are connected to the two ends of the induction coil, and the intermediate point of the pair of capacitors is grounded. In the present invention, the term "ground" refers to a stable potential.

If desired, the power factor improving capacitor may be accommodated in the heating roller. However, the power factor improving capacitor may be arranged outside the heating roller. Further, the power factor improving capacitor may be arranged in a recess formed in a coil bobbin regardless of whether the power factor improving capacitor is arranged inside or outside the heating roller.

[High-Frequency Power Source]

The high-frequency power source is a means for biasing the induction coil. The output frequency of the high-frequency power source is not restricted. However, it is preferred that the high-frequency power source have an output with a frequency of 100 kHz or greater, and more preferably, 1 MHz or greater when the induction coil and the heating roller employ the air-core transformer coupling method. This is because with a frequency of 100 kHz or greater, it becomes possible to increase the Q of the induction coil and further increase the power transmission efficiency. A higher power transmission efficiency increases the total heating efficiency and reduces power consumption. In practice, the problem of radiation noise can be readily avoided by using a frequency of 15 MHz or lower. From the perspective of economy of compatible active elements (for example, a MOSFET as described later) and ease of high-frequency noise suppression, a range of 1 to 4 MHz is preferred. The present invention may also employ an induction coil and a heating roller of the eddy current coupling method, in which case a frequency range of 20 to 100 kHz is preferred.

In generating a high-frequency, it is practical to use active elements, such as semiconductor switches, to directly or indirectly convert a direct current or low frequency alternating current to high-frequency. When obtaining high-frequency power from a low-frequency alternating current, a rectification means may be used to convert the low-frequency alternating current to direct current. The direct current may be a smoothed direct current, which is produced by a smoothing circuit, or a non-smoothed direct current. When converting a direct current to high-frequency, an amplifier and circuit elements such as an inverter and the like may be used. For example, an E-class amplifier or the like having a high power transmission efficiency may be used as an amplifier. In addition, a half-bridge type inverter also may be used. A MOSFET having superior high-frequency characteristics is desirable as an active element. A plurality of high-frequency power circuits may be connected in parallel to synthesize the high-frequency output of each high-frequency power circuit before applying the high-frequency output to the induction coils. In this way, the output of each high-frequency power supply circuit may be small and a MOSFET may be used as the active device while obtaining the required power. This arrangement inexpensively and efficiently generates the high-frequency.

By varying the frequency of the output of the high frequency power source, the power applied to each induction coil may be separately controlled. Further, if necessary, the power used during activation may be increased in comparison to normal operation to perform high speed heating.

Furthermore, the high-frequency power source may be arranged so as to have the high-frequency power shared by a plurality of induction coils. This allows power supplied to the respective induction coils to be controlled independently. However, a plurality of frequency-changeable high-frequency power sources may be provided to the respective induction coils individually.

Furthermore, when necessary, the input power may be greater at start-up than during normal operation for rapid heating of the roller.

[Other Structures of the Invention]

Although not required for the structural conditions of the present invention, the following structures may be selectively added to the present invention as desired to improve performance and increase functionality, so as to obtain a more effective induction heating roller device.

1. High-Frequency Transmission Line

A high-frequency transmission line supplies high-frequency power from a high-frequency power source, through a matching circuit, if desired, to an induction coil positioned at a distance from the high-frequency power source and the matching circuit. The length of the high-frequency transmission line may be 100 mm or more. Of course, the high-frequency transmission line need not be used if it is unnecessary.

2. Matching Circuit

A matching circuit includes a circuit means for increasing the power transmission efficiency that performs impedance conversion between an internal impedance of the high-frequency power source and a load impedance when the internal impedance differs from the load impedance.

3. Coil Bobbin

The coil bobbin is formed of a material having the smallest possible induction loss and superior heat resistance to support the induction coil in a predetermined shape and position.

The coil bobbin may have a winding groove to support the coils in an aligned state. Furthermore, a high-frequency transmission connected to the induction coil may be accommodated within the hollow coil bobbin, or a power-factor improving capacitor may be accommodated within the coil bobbin.

4. Warm-Up Control

During the warm-up after actuation of the apparatus or after the power supply has started, the heating roller may be controlled so as to rotate at a speed that is lower than the rotation speed during normal operation.

6. Heating Roller Temperature Control

A heat-sensitive element may be positioned in heat-conductive contact with the surface of the heating roller so as to maintain the temperature of the heating roller at a constant value within a predetermined range, for example, 200° C. The heat-sensitive element is connected to a temperature control circuit. A thermistor having negative temperature characteristics or a nonlinear resistance element having positive temperature characteristics may be used as the heat-sensitive element.

[Operation of the First Aspect of the Present Invention]

In the present invention, the power factor improving capacitor has a grounded intermediate point configuration. Thus, the power factor improving capacitor serves as a feedback route for regenerating leakage current, which is produced by the distributed capacitance between the induction coil and the heating roller, in the high-frequency power source. In other words, the intermediate point grounding of the power factor improving capacitor causes imbalanced leakage current leaking from the heating roller or the induction coil, due to the distributed capacitance, to flow to the high-frequency power source for regeneration from the grounded point of the power factor improving capacitor via the power factor improving capacitor. This prevents leakage current from leaking out of the induction coil and from the proximity of the heating roller side as common mode noise.

Further, the power factor improving capacitor is connected in parallel to and near the induction coil. This decreases the reactance of the load (induction coil), improves the power factor of the high frequency current flowing through the high frequency power source, and decreases the VA of the high-frequency current flowing through an electric line between the high-frequency power source and the induction coil. This decreases the current capacitance of the electric line. Thus, the electric line may be configured with a narrow conductive line. This decreases costs and facilitates wire layout. Further, since the high-frequency current flowing through the electric line decreases, the noise emitted from the electric line decreases.

In a second aspect of the present invention, a induction heating roller device includes an induction coil, a heating roller magnetically coupled with the induction coils and heated by an induction current, a power factor improving capacitor connected in parallel to and near the induction coil and having a grounded intermediate point, a high-frequency power source for biasing the induction coil, a high-frequency transmission line connecting the high-frequency power source and the induction coil, and a matching circuit connected between the high-frequency power source and the high-frequency transmission line and located near the high-frequency power source.

[High-Frequency Transmission Line]

In the present invention, "high-frequency transmission line" refers to a transmission means for supplying the high-frequency power generated by the high-frequency power source to the induction coil via the matching circuit. The high-frequency transmission line includes two parallel lines, a co-axial passage and a waveguide. Accordingly, the high-frequency transmission line extends between and electrically connects the high-frequency power source and the induction coil via the matching circuit. Further, it is preferred that the high-frequency transmission line be arranged near the inner surface or outer surface of the induction coil in the heating roller. When the high-frequency transmission line, which includes two parallel lines, extends through the induction coil near a center axis of the induction coil, the magnetic fluxes intersecting the high-frequency transmission line increases. This produces eddy current low in the induction coil and decreases power transmission efficiency. Thus, such an arrangement is not preferable. In comparison, the above structure of the present invention decreases the magnetic fluxes intersecting the high-frequency transmission line and relatively suppresses decrease of the power transmission efficiency.

[Matching Circuit]

The circuit configuration of the matching circuit is not restricted and may be selected from a variety of known circuit configurations. However, from the viewpoint of the matching circuit, the load includes the high-frequency transmission line and the induction coil. Thus, the induction coil and the high-frequency power source are not necessarily matched.

[Operation of the Second Aspect of the Present Invention]

In addition to the operation of the first aspect, the power-factor of the high-frequency current flowing through the high-frequency transmission line and the matching circuit is increased and the VA of the high-frequency transmission line and the matching circuit is decreased. This decreases the current capacity of the high-frequency transmission line and the matching circuit and enables the employment of a narrow electric wire for the high-frequency transmission line and the employment of circuit elements having a small current capacity for the matching circuit. This decreases cost and facilitates the layout of the high-frequency transmission line.

Further, the high-frequency current flowing through the high-frequency transmission line decreases. This reduces the noise emitted from the high-frequency transmission line.

In a third aspect of the present invention, a fixing device includes a fixing device body including a heating roller, and the induction heating roller device of the first and second aspects in which a pressure roller and a heating roller, which is disposed in pressure contact with the pressure roller, transport a recording medium bearing a toner image by holding the recording medium between the pressure roller and the heating roller to fix the toner image.

In the present invention, the fixing device body is the part of the fixing device remaining after removing the heating roller of the induction heating device or induction heating roller device from the fixing device.

The pressure roller and the heating roller may be disposed so as to press directly against each other, or may be disposed in indirect pressure contact through a transfer sheet when necessary. The transfer sheet may be of the endless type or roller type.

In the present invention, although the heating roller may directly contact the heated object when the heating roller heats a heated object, the heating roller may also indirectly contact the heated object through the transfer sheet passing between the heating roller and the heated object. In this case, the transfer sheet may be an endless type or a roller type. By using the transfer sheet, the heated object can be smoothly heated and transported.

In the present invention, the toner image can be fixed while the recording medium bearing the toner image is transported between the heating roller and the pressure roller.

In a fourth aspect of the present invention, an image forming apparatus includes an image forming apparatus body having an image forming means for forming a toner image on a recording medium, and a fixing device of the third aspect of the present invention arranged in the image forming apparatus body to fix the toner image on the recording medium.

In the present invention, the image forming apparatus body is the part of the image forming apparatus remaining after removing the fixing device. The image forming means is a means of forming an image created by image information on a recording medium by an indirect method or a direct method. Indirect methods are methods of forming an image by transcription.

For example, an electrophotographic copier, printer, facsimile apparatus and the like may be used as the image forming apparatus.

Examples of recording media include transfer sheets, printing paper, electrofax sheets, electrostatic recording sheets and the like.

In the present invention, an image forming apparatus including the induction heating roller device of the first and second aspects has a short warm-up time.

Other aspects and advantages of the invention will become apparent from the following description, taken in conjunction with the accompanying drawings, illustrating by way of example, the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
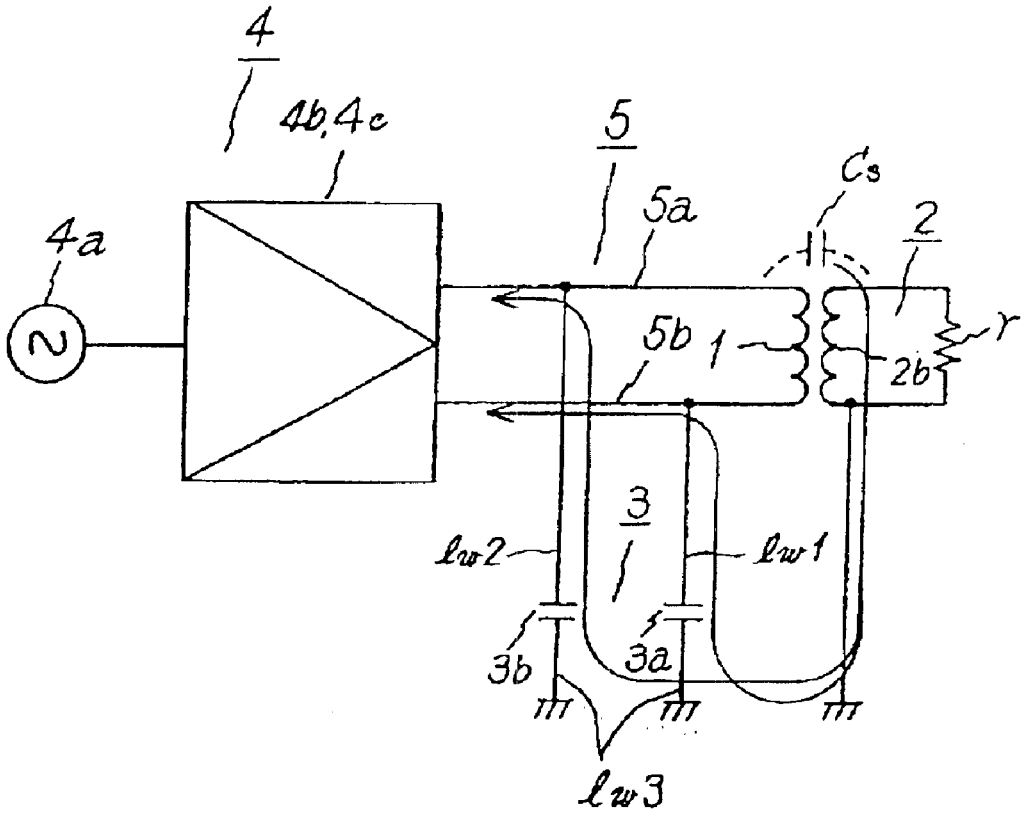
FIG. 1 is a schematic circuit diagram of an induction heating roller device according to a first embodiment of the present invention.

In the drawings, like numerals are used for like elements. The present invention will now be discussed with reference to the drawings.

Figure 2:
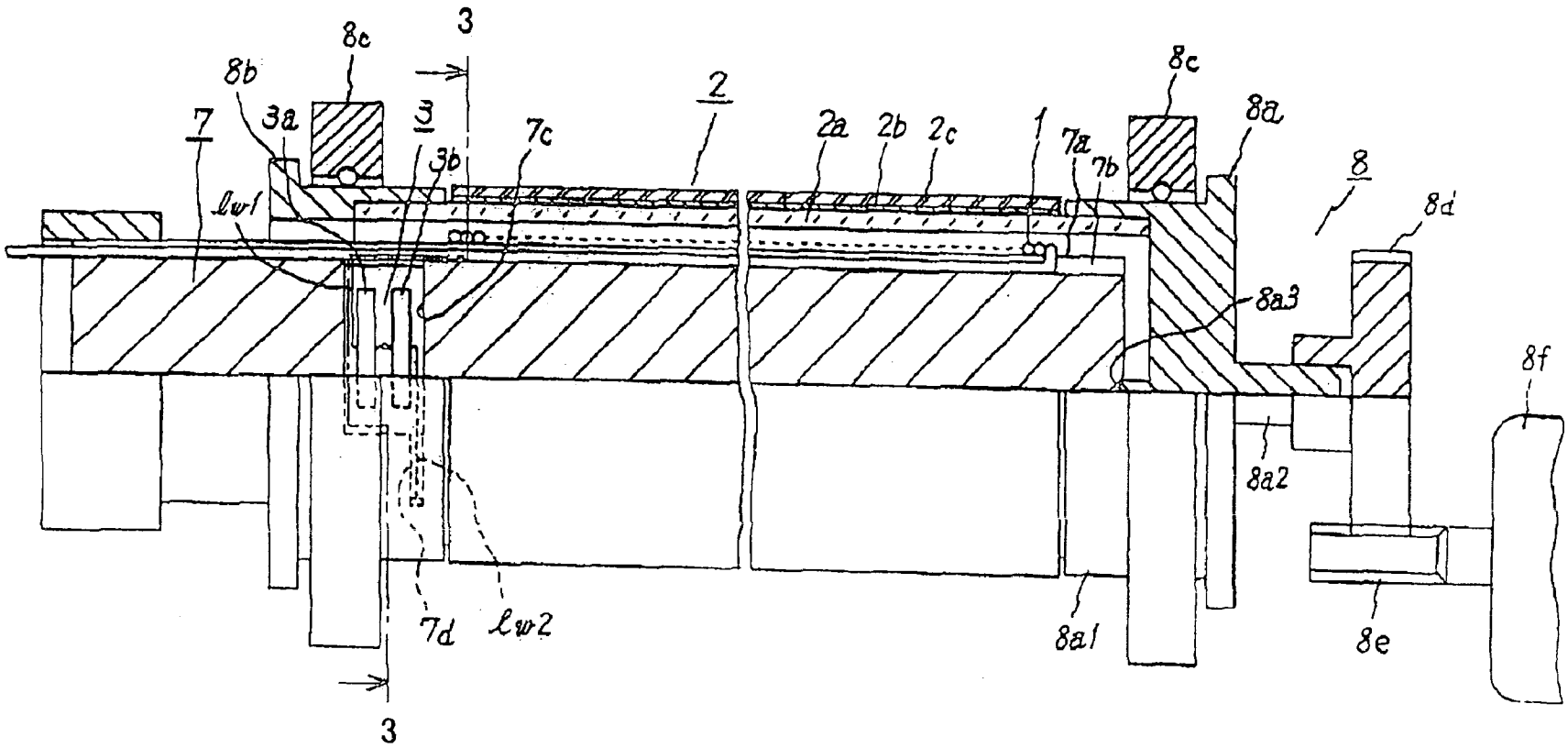
FIG. 2 is a partial cutaway vertical cross-sectional view of an induction coil and heating roller of the induction heating roller device of FIG. 1.
Figure 3:
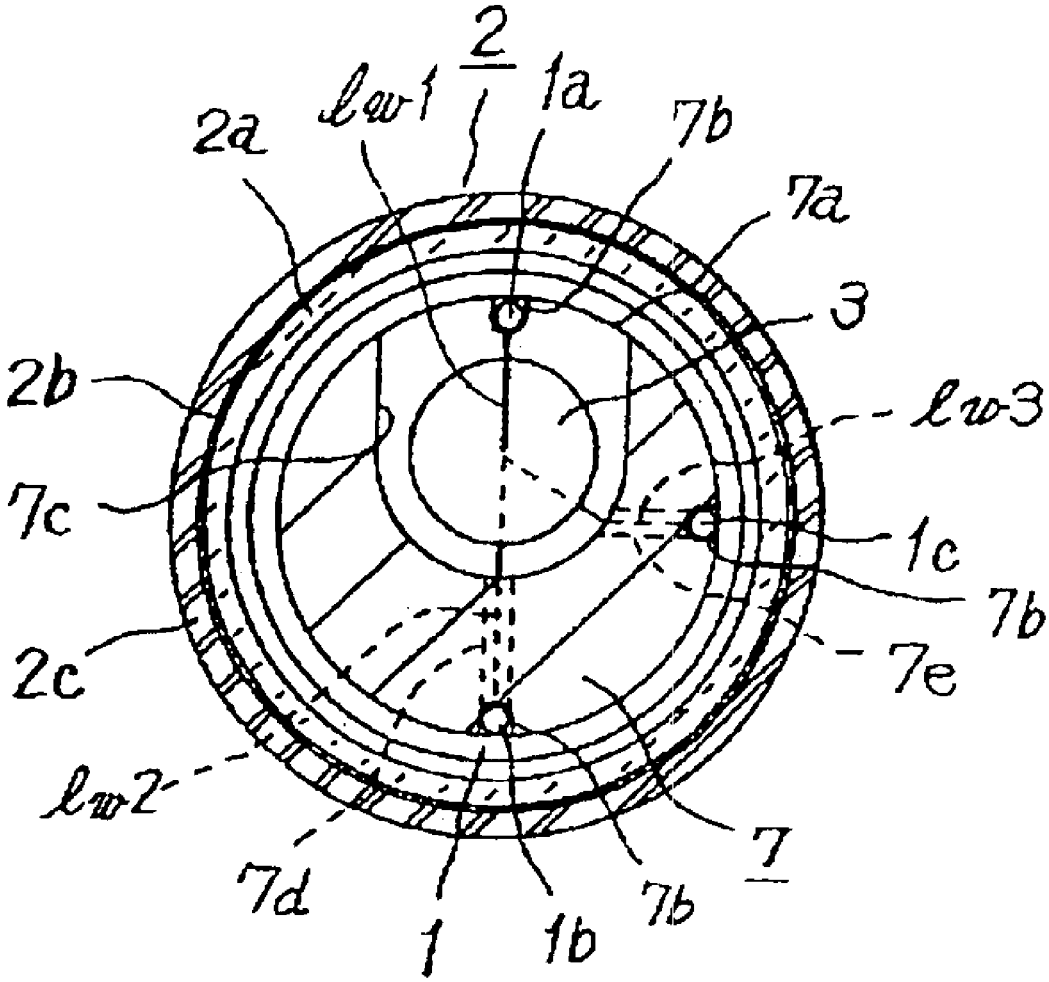
FIG. 3 is a cross-sectional view of the induction coil and heating roller taken along line 3—3.
Figure 4:
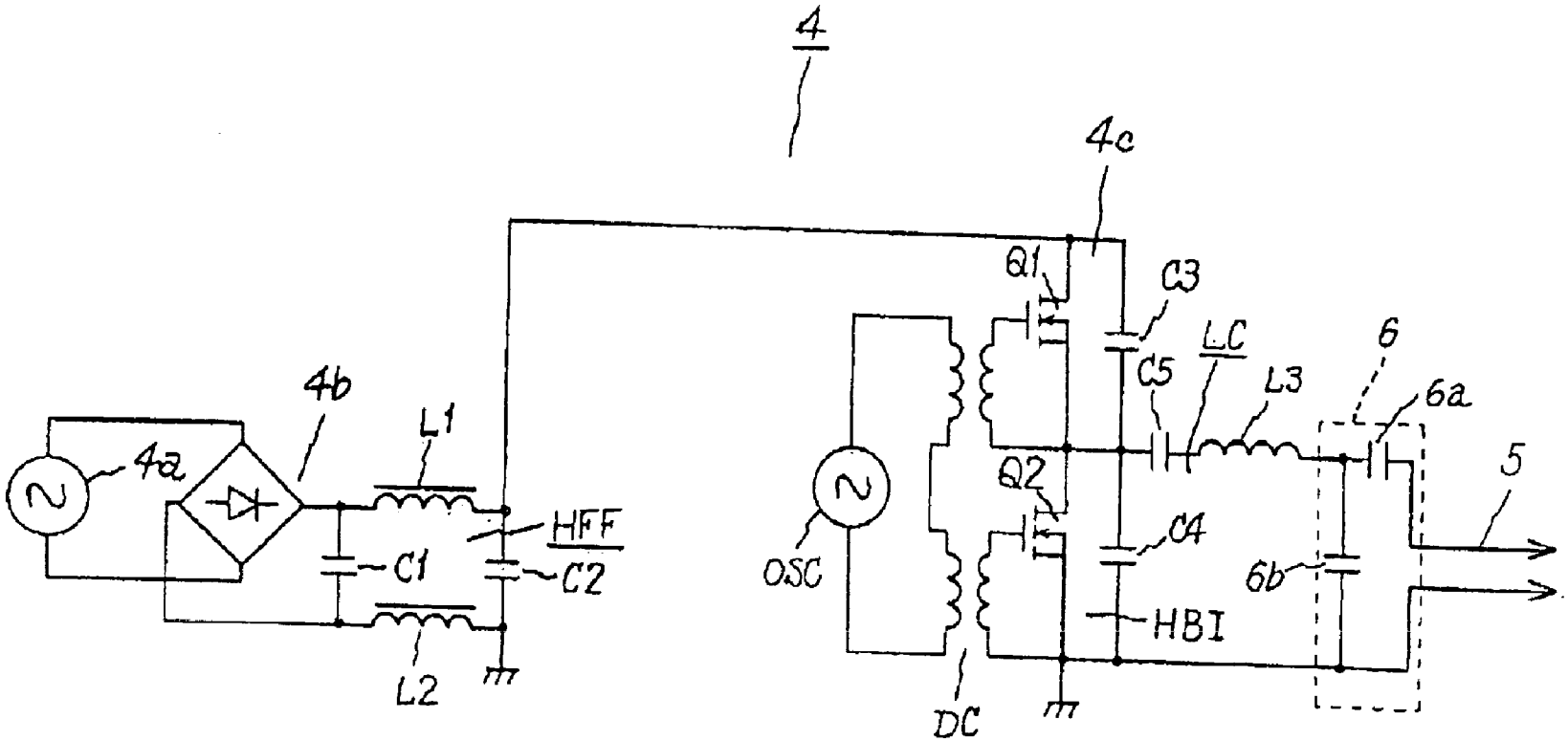
FIG. 4 is a circuit diagram of the induction heating roller device of FIG. 1.

FIGS. 1 and 4 are schematic circuit diagrams of an induction heating roller device according to a first embodiment of the present invention. FIG. 2 is a cross-sectional view of an induction coil and the heating roller. FIG. 3 is a cross-sectional view taken along line 3—3. FIG. 4 is a circuit diagram of a high-frequency power source and a matching circuit.

In the present embodiment, an induction coil device includes an induction coil 1, a heating roller 2, a power factor improving capacitor 3, a high-frequency power source 4, a high-frequency transmission line 5, a matching circuit 6, a coil bobbin 7, and a rotation mechanism 8. Each of these elements will now be described.

[Induction Coil 1]

Referring to FIGS. 2 and 3, the induction coil 1 is wound about the coil bobbin 7 and connected in parallel to the terminal end of the high-frequency transmission line 5. Further, as shown in FIG. 3, the induction coil 1 is connected in parallel between a pair of wires 1*a* and 1*b*.

[Heating Roller 2]

As shown in FIGS. 2 and 3, the heating roller 2 is provided with a roller base 2*a*, a secondary coil 2*b*, and a protective layer 2*c*. A rotation mechanism 9 rotates the heating roller 2. The roller base 2*a* is a cylinder formed of alumina ceramic, and has, for example, a length of 300 mm and a thickness of 3 mm. The secondary coil 2*b* is a single-turn film-like cylindrical coil formed by Cu vapor deposition and arranged along the entire effective length of the exterior surface of the roller base 2*a* in the axial direction. The thickness of the secondary coil 2*b* is set such that the value of the secondary side resistance r in the circumferential direction of the heating roller 2 is 1Ω, the value of which is substantially the same as the secondary reactance. The protective layer 2*c* is a fluororesin, which coats the exterior surface of the secondary coil 2*b*.

[Power Factor Improving Capacitor 3]

The power factor improving capacitor 3 is connected in series between the two ends of the induction coil 1 and includes two ceramic capacitors 3*a* and 3*b*, which are grounded at an intermediate point of the series connection. That is, the power factor improving capacitor 3 includes the first ceramic capacitor 3*a*, which is connected between one end of the induction coil 1 and the ground, and the second ceramic capacitor 3*b*, which is connected between the other end of the induction coil 1 and the ground. As shown in FIGS. 2 and 3, the power factor improving capacitor 3 is accommodated in a recess 7*c* of the coil bobbin 7.

In more detail, referring to FIGS. 2 and 3, three lead wires lw1, lw2, and lw3 extend from the two series-connected ceramic capacitors 3*a* and 3*b*. The lead wires lw1 is connected to the wire 1*a*, the lead wire lw2 is inserted through an insertion hole 7*d* and connected to the wire 1*b*, and the lead wire lw3 is inserted through the insertion hole 7*e* and connected to the wire 1*c*. The lead wires lw1 and lw2 are connected to the high-frequency transmission line 5 via the pair of wires 1*a* and 1*b*, and the lead wire lw3 is grounded via the wire 1*c*.

[High-Frequency Power Source 4]

As shown schematically in FIG. 1 and shown in detail in FIG. 4, the high-frequency power source 4 includes a low-frequency AC power source 4*a*, a DC power source 4*b*, and a high-frequency generator 4*c*. In FIG. 4, LC denotes a load circuit.

The low-frequency AC power source 4*a* is, for example, a commercial 100 V alternating current source.

The DC power source 4*b* is a rectifying circuit, which has an input terminal connected to the low-frequency AC power source 4*a*, and converts the low-frequency alternating current voltage to a non-smoothed DC voltage, which is output from a DC output terminal.

The high-frequency generator 4*c* has a high-frequency filter HFF, a high-frequency oscillator OSC, a drive circuit DC, and a half-bridge inverter main circuit HBI. The high-frequency filter HFF has a pair of series-connected inductors L1 and L2 connected to the two lines and a pair of capacitors C1 and C2 connected between the two lines before and after the pair of inductors L1 and L2. Further, the high-frequency filter HFF is arranged between the DC power source 4*b* and the half-bridge inverter main circuit HBI to prevent the high-frequency from entering the low-frequency AC power source AS. The high-frequency oscillator OSC generates a high-frequency signal having a predetermined frequency and inputs the signal to a drive circuit DC. The drive circuit DC is a preamplifier, which amplifies the high-frequency signal received from the high-frequency oscillator OSC to output a drive signal. The half-bridge inverter main circuit HBI has a pair of MOSFETs Q1 and Q2, which are connected in series between the output terminals of the DC power source 4*b* and are alternately driven by the drive signal of the drive circuit DC. A pair of capacitors C3 and C4 are connected in parallel to the pair of MOSFETs Q1 and Q2. The half-bridge main circuit HBI converts the DC output of the DC power source 4*b* to a high-frequency having a substantially rectangular wave. The capacitors C3 and C4 act as a high-frequency bypass during inversion operations.

The load circuit LC includes a DC cut capacitor C5, an inductor L3, the matching circuit 6, and the power factor improving capacitor 3 (FIG. 1). The DC cut capacitor C5 prevents a DC component from flowing to the load circuit LC from the DC power source DC side via the MOSFETs Q1, Q2. The inductor L3, the matching circuit 6, and the power factor improving capacitor 3 form a series resonance circuit and waveform-shapes the high-frequency voltage applied to the two ends of the induction coil 1 to a sine wave. The induction coil 1 is biased by the waveform-shaped high-frequency voltage.

[High-Frequency Transmission Line 5]

The high-frequency transmission line 5 includes two parallel lines, connects the matching circuit 6 to the induction coil 1, and has a terminal end connected to the power factor improving capacitor 3. The high-frequency power source 4 and the matching circuit 6 are separated from the induction coil 1 so that it is not thermally interfered by the induction coil 1 via the high-frequency transmission line 5.

[Matching Circuit 6]

The matching circuit 6 is an impedance conversion circuit that includes a capacitor 6*a* connected in series to the high-frequency transmission line 5 and a capacitor 6*b* connected in parallel to the high-frequency transmission line 5. The matching circuit 6 balances the internal impedance of the high-frequency power source 4 with the load side impedance at the load side relative to the initial end of the high-frequency transmission line 5.

[Coil Bobbin 7]

Referring to FIGS. 2 and 3, the coil bobbin 7 includes a winding groove 7*a,* which winds the induction coil 1 in an aligned state along the peripheral surface, three wire grooves 7*b,* which extend axially at three locations on the peripheral surface, three recesses 7*c,* which are connected with the three wire grooves 7*b,* insertion holes 7*d* and 7*e,* and a cantilever support. The recess 7*c* extends through part of the coil bobbin 7. The power factor improving capacitor 3 is accommodated in the recess 7*c*. The insertion holes 7*d* and 7*e* extend between the recess 7*c* and the wire groove 7*b*. The lead wires lw2 and lw3 of the power factor improving capacitor 3 are respectively inserted through the insertion holes 7*d* and 7*e*. The cantilever support supports the coil bobbin 7 in a cantilevered state.

[Rotation Mechanism 8]

The rotation mechanism 8 is a mechanism for rotating the heating roller 2 and is configured as follows. Referring to FIG. 2, the rotation mechanism 8 is provided with a first end member 8*a,* a second end member 8*b,* a pair of bearings 8*c,* a bevel gear 8*d,* a spline gear 8*e,* and motor 8*f*. The first end member 8*a* includes a cap 8*a*1, a drive shaft 8*a*2, and a tip end 8*a*3. The left end of the cap 8*a*1, as viewed in FIG. 2, engages the heating roller 2 and is fixed to the heating roller 2 by a setscrew (not shown) so as to support the left end of the heating roller. The drive shaft 8*a*2 extends outward from the outer central portion of the cap 8*a*1. The tip end 8*a*3 extends inward from the inner central portion of the cap 8*a*1. The second end member 8*b* includes a ring 8*b*1. The ring 8*b*1 engages the right end of the heating roller 2 from the outside and is fixed to the heating roller 2 by a setscrew (not shown) so as to support the right end of the heating roller 2. One of the pair of bearings 8*c* rotatably supports the outer surface of the cap 8*a*1 of the first end member 8*a*. The other one of the two bearings 8*c* rotatably supports the outer surface of the second end member 8*b*. Accordingly, the heating roller 2 is rotatably supported by the first and second end members 8*a* and 8*b,* which are attached to the ends of the heating roller 2, and the pair of bearings 8*c*. The bevel gear 8*d* is attached to the drive shaft 8*a*2 of the first end member 8*a*. The spline gear 8*e* is meshed with the bevel gear 8*d*. A rotor shaft of the motor 8*f* is directly connected to the spline gear 8*e*.

[Induction Heating Roller Device Operation]

In the high-frequency power source 4, the low-frequency AC voltage of the low-frequency AC power source 4*a* is converted to a DC voltage by the DC power source 4*b* and further converted to high-frequency power by the high-frequency power source 4*c*. The high-frequency power is output from the high-frequency power source 4 and sent to the matching circuit 6, which performs impedance conversion on the high-frequency power and sends the converted power to the high-frequency transmission line 5.

The induction coil 1, which is in a stationary state, and the power factor improving capacitor 3 are connected in parallel to the terminal end of the high-frequency transmission line 5. This increases the power factor of the high-frequency current flowing through the high-frequency transmission line 5 and decreases the high-frequency current flowing through the high-frequency transmission line 5 even if the high-frequency power supplied to the induction coil 1 is the same as in the prior art.

When a high-frequency voltage is applied to the induction coil 1, secondary voltage is induced in the secondary coil 2*b* of the magnetically-coupled heating roller 2. This generates secondary current in the circumferential direction of the heating roller 2 and heats the heating roller 2 to a desired temperature through resistance heating.

The power factor improving capacitor 3 has a grounded intermediate point structure. Thus, referring to FIG. 1, the leakage current that flows to the ground via a distributed capacitance Cs between the induction coil 1 and the heating roller 2 returns to the high-frequency transmission line 5 from the ground via the lead wire lw3, the ceramic capacitor 3*a* and the lead wire lw1, or the lead wire lw3, the ceramic capacitor 3*b* and the lead wire lw2 to be regenerated by the high-frequency power source 4. The power factor improving capacitor 3 is located in the vicinity of the induction coil 1. Thus, the leakage current is returned to the high-frequency power source 4 from the vicinity of the induction coil 1 and does not leak out of the induction heating device.

Figure 5:
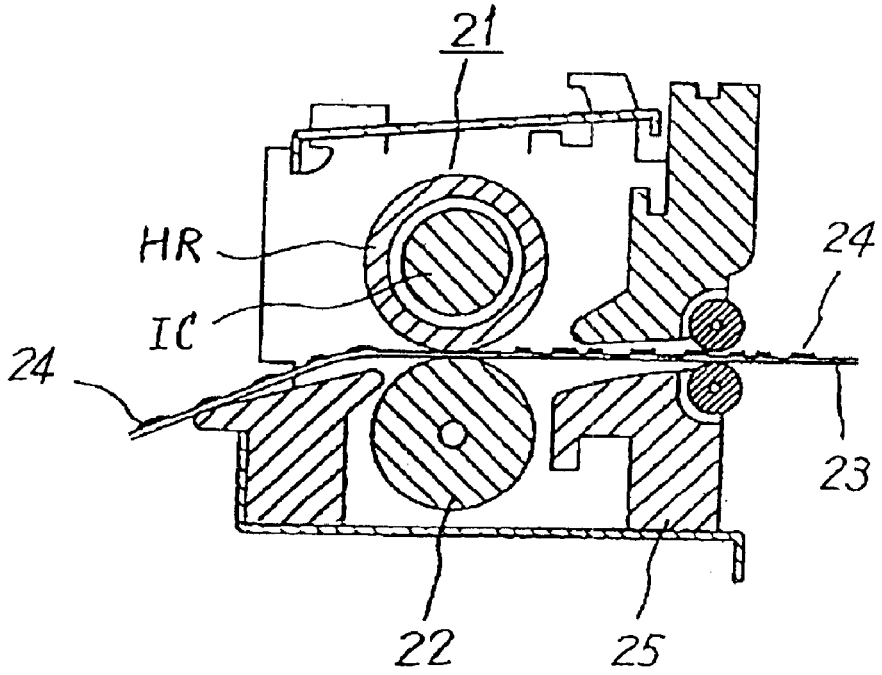
FIG. 5 is a schematic diagram of a fixing device provided with the induction heating roller device of FIG. 1.

FIG. 5 is a cross-sectional view showing a fixing device according to a preferred embodiment of the present invention. The fixing device includes an induction heating roller device 21, a pressure roller 22, a recording medium 23, a toner 24, and a frame 25.

The first embodiment shown in FIGS. 1 through 5 are applied to the induction heating roller device 21.

The pressure roller 22 is arranged so as to press against the heating roller TR of the induction heating roller device 21, and a recording medium 23 is transported between the two rollers.

The recording medium 23 forms an image by adhering the toner 24 to the surface of the recording medium 23.

The frame 25 holds the structural elements (excluding the recording medium 23) mentioned above in predetermined positional relationships.

The fixing device transports the recording medium 23, which bears the image formed by the toner 24, in a state inserted between the heating roller TR and the pressure roller 22 of the induction heating roller device 21, and heats the toner 24 with the heat from the heating roller TR so as to melt and thermally fix the toner to the recording medium.

Figure 6:
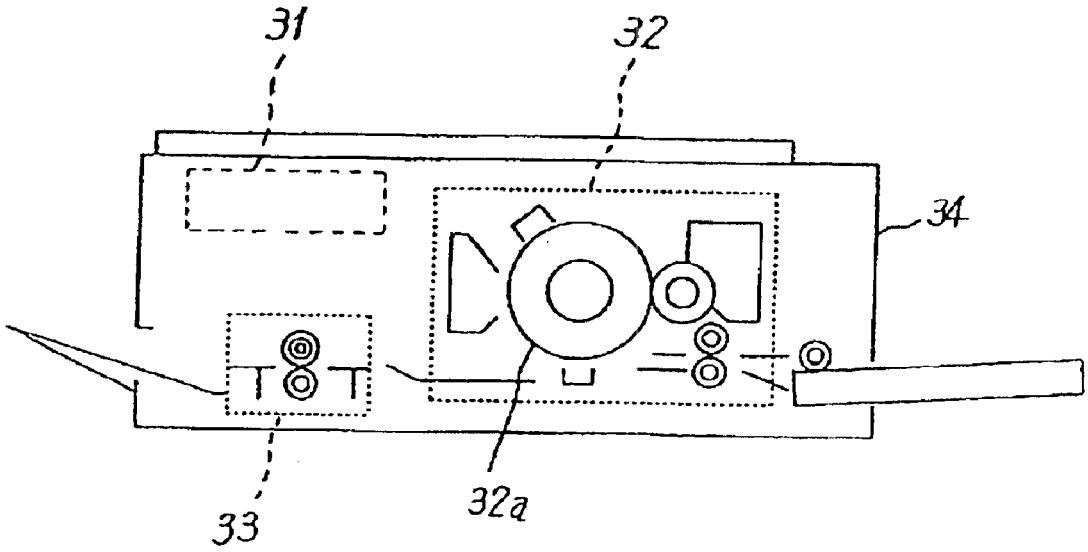
FIG. 6 is a schematic diagram of an image forming apparatus provided with the fixing device of FIG. 5.

FIG. 6 is a schematic cross-sectional view showing a copier serving as an image forming apparatus provided with the fixing device of the present invention. The copier includes a reading device 31, an image forming means 32, a fixing device 33, and an image forming apparatus case 34.

The reading device 31 optically reads a document and generates image signals.

The image forming means 32 forms an electrostatic latent image on a photosensitive drum 32*a* based on the image signals, and forms a reverse image by adhering toner on the electrostatic latent image, and then transcribing the image onto a recording medium such as a paper sheet or the like.

The fixing device 33 has the structure shown in FIG. 5, and heats the toner on the recording medium to melt and thermally fix the toner to the recording medium.

The image forming apparatus case 34 is provided with each of the aforesaid devices, and accommodates devices 31 through 33, and is further provided with a transport device, power source, a controller, and the like.

It should be apparent to those skilled in the art that the present invention may be embodied in many other specific terms without departing from the spirit or scope of the invention. Therefore, the present examples, and embodiments are to be considered as illustrative and not restrictive and the invention is not to be limited to the details given herein, but may be modified within the scope and equivalence of the appended claims.

What is claimed is:

1. An induction heating roller device comprising:

an induction coil;

a grounded heating roller magnetically coupled to the induction coil and heated by electro-magnetic induction;

a power factor improving capacitor connected in parallel to and near the induction coil and having a grounded intermediate point; and a high-frequency power source for biasing the induction coil.

2. The induction heating roller device of claim 1, wherein the power factor improving capacitor includes two series-connected capacitors, wherein an intermediate point between the capacitors is grounded.

3. The induction heating roller device of claim 1, wherein the induction coil includes a first terminal and a second terminal, and the power factor improving capacitor includes a first capacitor connected between the first terminal and the ground and a second capacitor connected between the second terminal and the ground.

4. The induction heating roller device of claim 1, further comprising a coil bobbin for winding the induction coil, wherein the coil bobbin includes a recess for accommodating the power factor improving capacitor.

5. The induction heating roller device of claim 1, wherein the high-frequency power source is separated from the induction coil.

6. An induction heating roller device comprising:

an induction coil;

a grounded heating roller magnetically coupled to the induction coil and heated by electro-magnetic induction;

a power factor improving capacitor connected in parallel to and near the induction coil and having a grounded intermediate point;

a high-frequency power source for biasing the induction coil;

a high-frequency transmission line connecting the high-frequency power source and the induction coil; and a matching circuit connected between the high-frequency power source and the high-frequency transmission line and located near the high-frequency power source.

7. The induction heating roller device of claim 6, wherein the power factor improving capacitor includes two series-connected capacitors, wherein an intermediate point between the capacitors is grounded.

8. The induction heating roller device of claim 6, wherein the induction coil includes a first terminal and a second terminal, and the power factor improving capacitor includes a first capacitor connected between the first terminal and the ground and a second capacitor connected between the second terminal and the ground.

9. The induction heating roller device of claim 6, further comprising a coil bobbin for winding the induction coil, wherein the coil bobbin includes a recess for accommodating the power factor improving capacitor.

10. The induction heating roller device of claim 6, wherein the high-frequency power source and the matching circuit are separated from the induction coil.

11. The induction heating roller device of claim 6, wherein the high-frequency transmission line is arranged near the induction coil in the heating roller.

12. A fixing device for use with a recording medium bearing a toner image, the fixing device comprising:

a pressure roller; and an induction heating roller device including a heating roller arranged in pressure contact with the pressure roller, wherein the heating roller transports the recording medium bearing a toner image by holding the recording medium with the pressure roller and fixes the toner image on the recording medium, the induction heating roller device further including:

an induction coil;

a grounded heating roller magnetically coupled to the induction coil and heated by electro-magnetic induction;

a power factor improving capacitor connected in parallel to and near the induction coil and having a grounded intermediate point; and a high-frequency power source for biasing the induction coil.

13. A fixing device for use with a recording medium bearing a toner image, the fixing device comprising:

a pressure roller; and an induction heating roller device including a heating roller arranged in pressure contact with the pressure roller, wherein the heating roller transports the recording medium bearing a toner image by holding the recording medium with the pressure roller and fixes the toner image on the recording medium, the induction heating roller device further including:

an induction coil;

a grounded heating roller magnetically coupled to the induction coil and heated by electro-magnetic induction;

a power factor improving capacitor connected in parallel to and near the induction coil and having a grounded intermediate point;

a high-frequency power source for biasing the induction coil;

a high-frequency transmission line connecting the high-frequency power source and the induction coil; and a matching circuit connected between the high-frequency power source and the high-frequency transmission line and located near the high-frequency power source.

14. An image forming apparatus for use with a recording medium, the image forming apparatus comprising:

an image forming unit for forming a toner image on the recording medium;

a fixing device for transporting the recording medium bearing the toner image and fixing the toner image on the recording medium, the fixing device including:

a pressure roller; and an induction heating roller device including a heating roller arranged in pressure contact with the pressure roller, wherein the heating roller transports the recording medium bearing a toner image by holding the recording medium with the pressure roller and fixes the toner image on the recording medium, the induction heating roller device further including:

an induction coil;

a grounded heating roller magnetically coupled to the induction coil and heated by electro-magnetic induction;

a power factor improving capacitor connected in parallel to and near the induction coil and having a grounded intermediate point; and a high-frequency power source for biasing the induction coil.

15. An image forming apparatus for use with a recording medium, the image forming apparatus comprising:

an image forming unit for forming a toner image on the recording medium;

a fixing device for transporting the recording medium bearing the toner image and fixing the toner image on the recording medium, the fixing device including:

a pressure roller; and an induction heating roller device including a heating roller arranged in pressure contact with the pressure roller, wherein the heating roller transports the recording medium bearing a toner image by holding the recording medium with the pressure roller and fixes the toner image on the recording medium, the induction heating roller device further including:

an induction coil;

a grounded heating roller magnetically coupled to the induction coil and heated by electromagnetic induction;

a power factor improving capacitor connected in parallel to and near the induction coil and having a grounded intermediate point;

a high-frequency power source for biasing the induction coil;

a high-frequency transmission line connecting the high-frequency power source and the induction coil; and a matching circuit connected between the high-frequency power source and the high-frequency transmission line and located near the high-frequency power source.

* * * * *

UNITED STATES PATENT AND TRADEMARK OFFICE

CERTIFICATE OF CORRECTION

PATENT NO. : 6,861,626 B2
DATED : March 1, 2005
INVENTOR(S) : Ogasawara et al.

It is certified that error appears in the above-identified patent and that said Letters Patent is hereby corrected as shown below:

Title page,
Item [73], Assignee, replace "Ehine" with -- Ehime --

Column 2,
Line 31, replace "that keeps. leakage" with -- that keeps leakage --

Column 16,
Line 15, replace "electromagnetic" with -- electro-magnetic --

Signed and Sealed this

Twenty-eighth Day of June, 2005

JON W. DUDAS
*Director of the United States Patent and Trademark Office*